US012332014B2

(12) United States Patent
Porat et al.

(10) Patent No.: US 12,332,014 B2
(45) Date of Patent: Jun. 17, 2025

(54) FOLDABLE BREAK BARREL AIRGUN

(71) Applicant: Kore Outdoor (US) Inc., Fort Wayne, IN (US)

(72) Inventors: Tamir Porat, Tel Aviv-Jaffa (IL); John Ronald Rice, Staffordshire (GB); Martin Stelling, Holte (DK)

(73) Assignee: Kore Outdoor (US) Inc., Fort Wayne, IN (US)

( * ) Notice: Subject to any disclaimer, the term of this patent is extended or adjusted under 35 U.S.C. 154(b) by 0 days.

(21) Appl. No.: 18/463,602

(22) Filed: Sep. 8, 2023

(65) Prior Publication Data

US 2024/0085145 A1 Mar. 14, 2024

Related U.S. Application Data

(60) Provisional application No. 63/404,765, filed on Sep. 8, 2022.

(51) Int. Cl.
*F41B 11/648* (2013.01)

(52) U.S. Cl.
CPC ..... *F41B 11/648* (2013.01)

(58) Field of Classification Search
CPC ..... F41B 11/648; F41B 11/00; F41C 23/04; F41C 23/16; F41A 11/02
See application file for complete search history.

(56) References Cited

U.S. PATENT DOCUMENTS

| | | | | |
|---|---|---|---|---|
| 36,571 | A | 9/1862 | Moses | |
| 521,202 | A * | 6/1894 | Burgess | F41C 23/16 42/72 |
| 572,290 | A | 12/1896 | Clement | |
| 1,183,644 | A | 5/1916 | Hill | |
| 1,545,465 | A | 7/1925 | Johnstone | |
| 2,150,288 | A | 3/1939 | Moller | |

(Continued)

FOREIGN PATENT DOCUMENTS

| | | |
|---|---|---|
| GB | 2056635 B | 5/1983 |
| WO | 2002042708 A1 | 5/2002 |

OTHER PUBLICATIONS

Bushmaster; "Operating and Safety Instruction Manual", (For all Bushmaster XM15 Models), 1999.

(Continued)

*Primary Examiner* — Benjamin P Lee
(74) *Attorney, Agent, or Firm* — Volpe Koenig

(57) ABSTRACT

A foldable break barrel air gun that is movable from a stowed configuration to a use configuration. The foldable break barrel air gun includes a stock having a butt stock pivotally connected to a forestock in which a firing engine is located. A barrel having a muzzle end and a breech end is provided, with the barrel being pivotally connected to the forestock proximate the breech end. A cocking linkage has a first portion that is pivotally connected to the barrel and a second portion that is connected and/or engaged with the firing engine by a releasable linkage connection. With the releasable linkage connection released, the butt stock is foldable relative to the forestock, and the barrel is foldable relative to the forestock such that the butt stock is arranged in proximity to and preferably attachable to the barrel proximate to the muzzle end in the stowed configuration.

16 Claims, 14 Drawing Sheets

(56) References Cited

U.S. PATENT DOCUMENTS

| | | | | |
|---|---|---|---|---|
| 2,433,151 | A * | 12/1947 | Parsons | F41C 23/12 42/72 |
| 3,153,874 | A | 10/1964 | Merrill | |
| 3,229,400 | A | 1/1966 | Del Pozo, Jr. | |
| 3,233,601 | A | 2/1966 | Walther | |
| 3,318,192 | A | 5/1967 | Miller | |
| 3,379,188 | A | 4/1968 | Walther | |
| 3,561,149 | A | 2/1971 | Warren | |
| 3,782,019 | A * | 1/1974 | Venturini | F41C 23/12 42/72 |
| 3,791,256 | A | 2/1974 | Curtis | |
| 3,913,553 | A | 10/1975 | Braughler | |
| 3,996,685 | A | 12/1976 | Brauman | |
| 4,044,487 | A | 8/1977 | Hutton | |
| 4,299,046 | A | 11/1981 | Atchisson | |
| 4,541,192 | A | 9/1985 | Flodman | |
| 4,660,311 | A | 4/1987 | Breitfeld | |
| 4,757,627 | A | 7/1988 | Saligari | |
| 4,774,929 | A | 10/1988 | Milliman | |
| 4,999,939 | A | 3/1991 | Reese | |
| 5,062,231 | A | 11/1991 | Braverman | |
| 5,160,795 | A | 11/1992 | Milliman | |
| 5,165,383 | A | 11/1992 | Ebert | |
| 5,225,610 | A | 7/1993 | Uria | |
| 5,335,581 | A | 8/1994 | Simon | |
| 5,404,863 | A | 4/1995 | Poor | |
| 5,529,050 | A | 6/1996 | D'Andrade | |
| 5,610,362 | A | 3/1997 | Bouvard | |
| 5,622,160 | A | 4/1997 | Casas Salva | |
| 5,711,286 | A | 1/1998 | Petrosyan | |
| 5,722,383 | A | 3/1998 | Tippmann, Sr. | |
| 5,884,615 | A | 3/1999 | Casas Salva | |
| 5,924,233 | A * | 7/1999 | Strobel | F41C 23/12 42/72 |
| 6,119,671 | A | 9/2000 | Smith | |
| 6,539,659 | B2 | 4/2003 | Casas Salva | |
| 6,578,565 | B2 | 6/2003 | Casas Salva | |
| 6,637,310 | B2 | 10/2003 | Borgwarth | |
| 6,705,035 | B2 | 3/2004 | Beretta | |
| 6,766,795 | B1 | 7/2004 | Sullivan | |
| 6,907,687 | B2 | 6/2005 | Rousseau | |
| 7,207,130 | B2 | 4/2007 | Rousseau | |
| 7,594,503 | B2 | 9/2009 | Dehaan | |
| 7,665,396 | B1 | 2/2010 | Tippmann, Jr. | |
| 7,690,373 | B2 | 4/2010 | Telford | |
| D622,802 | S * | 8/2010 | Fitzpatrick | D22/104 |
| 7,770,571 | B2 | 8/2010 | Tippmann, Jr. | |
| 7,814,695 | B1 | 10/2010 | Keeney | |
| 7,900,622 | B2 | 3/2011 | Douglas | |
| 7,941,954 | B2 | 5/2011 | Carr | |
| 8,006,425 | B2 * | 8/2011 | Burt | F41A 11/04 42/73 |
| 8,015,907 | B2 | 9/2011 | Tippmann, Sr. | |
| 8,118,017 | B2 | 2/2012 | Lammonds | |
| 8,186,338 | B2 | 5/2012 | Dehaan | |
| 8,333,181 | B1 | 12/2012 | Rice | |
| 8,683,990 | B2 | 4/2014 | Macy | |
| 8,839,542 | B2 | 9/2014 | Dubois | |
| 8,950,387 | B2 | 2/2015 | Stevens | |
| 10,443,971 | B2 * | 10/2019 | Kielsmeier | F41A 35/06 |
| 11,466,949 | B2 * | 10/2022 | Kellgren | F41A 21/30 |
| 2007/0215134 | A1 | 9/2007 | DeHaan | |
| 2008/0099005 | A1 | 5/2008 | Kaakkola | |
| 2008/0190275 | A1 | 8/2008 | Tippmann | |
| 2008/0295818 | A1 | 12/2008 | Styles | |
| 2009/0025701 | A1 | 1/2009 | Douglas | |
| 2009/0120420 | A1 | 5/2009 | Tippmann, Jr. | |
| 2009/0194088 | A1 | 8/2009 | Tippmann, Jr | |
| 2009/0277066 | A1 * | 11/2009 | Burt | F41A 3/66 89/1.4 |
| 2010/0024791 | A1 | 2/2010 | Romney | |
| 2010/0071679 | A1 | 3/2010 | Dehaan | |
| 2012/0210992 | A1 | 8/2012 | Dehaan | |
| 2014/0144418 | A1 | 5/2014 | Macy | |
| 2016/0298916 | A1 | 10/2016 | Anderson | |
| 2017/0307314 | A1 | 10/2017 | Serbu | |
| 2021/0254927 | A1 * | 8/2021 | Freeman | F41A 3/66 |

OTHER PUBLICATIONS

FT-12 Owner's Manual, Ver. 05/12, Manufactured by Tippman (24 pages).

Tippman; "98 Custom Marker Line—Owner's Manual" date not available.

Tippman; "A-5 Paintball Marker, Owner's Manual", TP04122, Rev. Oct. 10.

Tippman; "X7Phenom Mechanical, Owner's Manual", TP04121, Rev. Aug. 10.

* cited by examiner

FOLDABLE BREAK BARREL AIRGUN

CROSS-REFERENCE TO RELATED APPLICATIONS

This application claims the benefit of U.S. Provisional Patent Application No. 63/404,765, filed Sep. 8, 2022, which is incorporated herein by reference as if fully set forth.

FIELD OF INVENTION

The present disclosure relates to the field of air-powered guns, and more particularly to manually actuated spring-piston or gas-spring powered air guns.

BACKGROUND

Various air guns are known in the art, that can be used to fire a pellet or BB. Certain of these air guns known as break barrel air guns use a barrel that is pivotally connected to the stock that can be pivoted toward the stock for cocking in order to generate and store energy (as compressed air) for firing a shot. Such break barrel air guns may contain a firing engine formed as either a spring-piston or a gas-spring in a cylinder that is pressurized by a cocking linkage either compressing the spring-piston against a spring or pressurizing gas in the cylinder with a piston. In each case, the barrel operates as a cocking lever to compress the piston. Cocking of a break barrel rifle can be carried out by placing the stock against the thigh with the barrel pointing up and at an angle such that an end of the barrel can be grasped and pulled downwardly causing a levered cocking mechanism to compress the piston. Alternatively, one hand can grasp the barrel and the other can grasp the stock and the barrel is then pulled downwardly toward the stock. Once pressurized (or cocked) and a pellet or BB inserted in the breech, the barrel is then raised and locked in the normal inline position. Pulling the trigger activates the firing engine to release compressed air behind the pellet or BB to fire it from the barrel.

Regardless of the spring type employed, break barrel air guns are known for their accuracy and can propel a .177 caliber pellet up to 1300 ft/sec. Because of the relatively simple mechanical pressurization means, these air guns have a high power to weight ratio and provide long and dependable service. Additionally, for camping and survivalist use, these types of air guns are preferred since there is no need for a CO2 cartridge and the only consumable is the ammunition that is being fired.

It would be desirable to provide a break barrel air gun that is more compact for storage and carrying, making it more convenient for users.

SUMMARY

In one aspect, a foldable break barrel air gun that is movable from a stowed configuration to a use configuration is provided. The foldable break barrel air gun includes a stock having a butt stock pivotally connected to a forestock in which a firing engine is located. A barrel having a muzzle end and a breech end is provided, with the barrel being pivotally connected to the forestock proximate the breech end. A cocking linkage has a first portion that is pivotally connected to the barrel and a second portion that is held in at least one of connected or engaged position with the firing engine by a releasable linkage connection. With the releasable linkage connection in a released position, the cocking linkage can be disconnected, the butt stock is foldable relative to the forestock, and the barrel is foldable relative to the forestock such that the butt stock is arranged in proximity to and more preferably attachable to the barrel proximate to the muzzle end in the stowed configuration.

In one embodiment, a releasable stock latch is provided that holds the butt stock to the forestock in the use configuration.

In one embodiment, a fore end stock is connected to and pivotable with the barrel, and the butt stock is attachable to the fore end stock proximate to the muzzle end of the barrel in the stowed configuration.

Preferably, a releasable butt stock to barrel latch is provided that releasably connects the butt stock to the fore end stock proximate to the muzzle end of the barrel in the stowed configuration.

In one embodiment, the cocking linkage is foldable to a position adjacent to the barrel in the stowed configuration.

In a preferred embodiment, the butt stock is a molded plastic or composite part. Additionally, the forestock is a molded plastic or composite part. This provides a lightweight, low maintenance arrangement.

In one embodiment, the releasable linkage connection includes a lever that is located on an outer surface of the forestock. This allows for easy manual release of the cocking linkage as well as provides a visual indicator when moving the air gun to the use position that the cocking linkage is re-engaged and connected to the firing engine.

In one embodiment, a portion of the butt stock in proximity to the pivotal connection to the forestock is configured to contact a trigger guard in the stowed configuration to limit a pivoting movement of the butt stock relative to the forestock.

In another aspect, the air gun further includes a stowage area formed between the butt stock, the forestock, and the barrel in the stowed configuration, and a container is located in the stowage area and is configured to engage at least one of the butt stock, the forestock, and the barrel.

In a preferred embodiment, the container includes a handle portion, and the butt stock includes a recess in which the handle portion is received in the stowed configuration.

Preferably, the container is formed of a molded plastic or composite material. Preferably, the container includes a base part and a hinged cover connected to the base part.

Preferably, a trigger is provided for activating the firing engine.

For the break barrel air gun, the firing engine can include a gas-spring or a spring-piston.

The features disclosed herein can be used together and in various combinations with one another in order to provide one or more of the benefits noted herein.

BRIEF DESCRIPTION OF THE DRAWINGS

The foregoing Summary and the following Detailed Description will be better understood when read in conjunction with the appended drawings, which illustrate a preferred embodiment of the disclosure. In the drawings.

DETAILED DESCRIPTION

Figure 1:
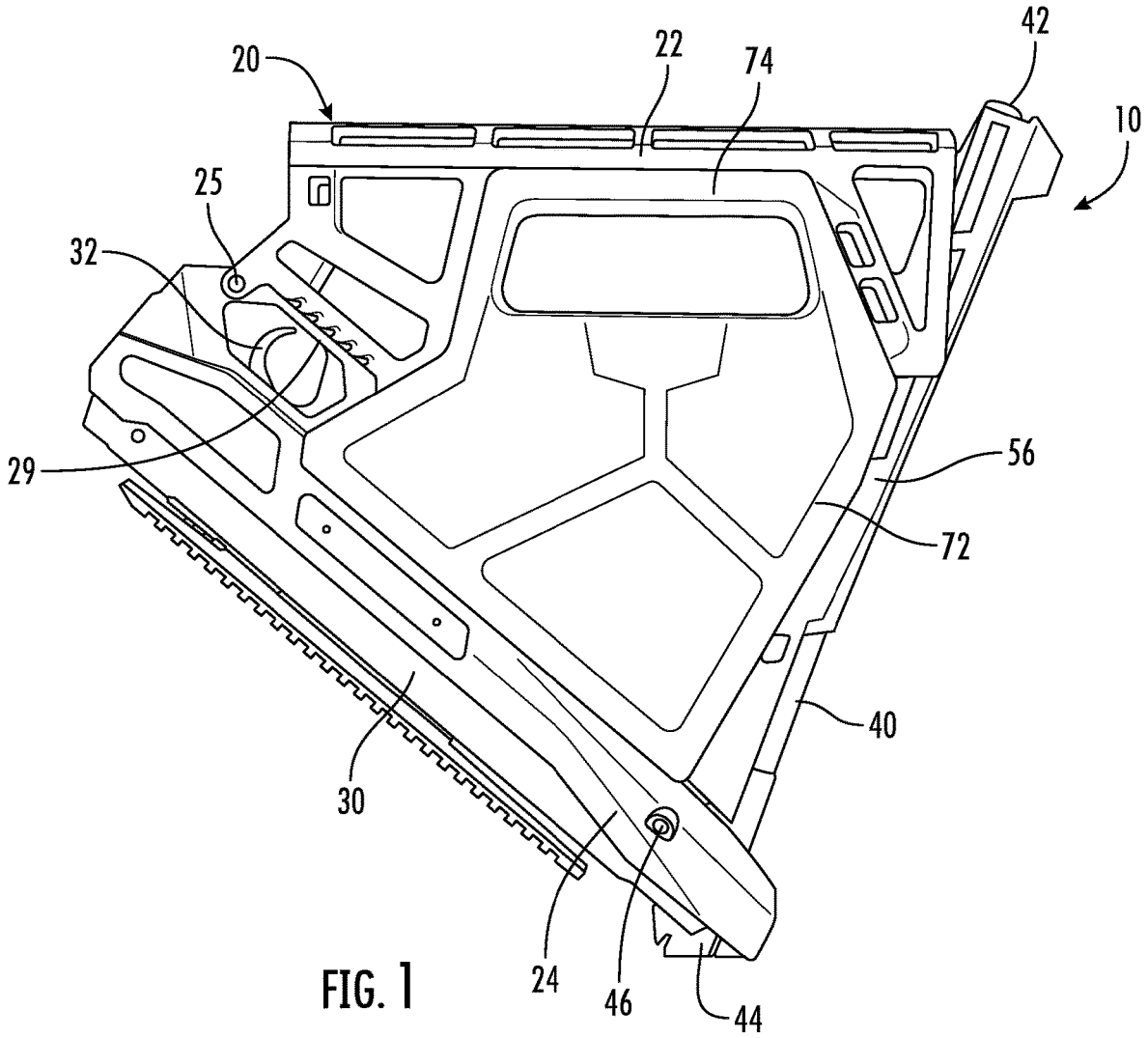
FIG. 1 is a side view of the foldable break barrel air gun in accordance with the present disclosure shown in a stowed configuration with a container located in the stowage area.

Certain terminology is used in the following description for convenience only and is not limiting. "Axially" refers to a direction along a longitudinal axis of an assembly. "Radially" refers to a direction inward and outward from the axis of the assembly. "Circumferentially" refers to a direction extending along a curve or circumference of a respective element relative to the axis of the assembly. The words "right," "left," "top," and "bottom" designate directions in the drawings to which reference is made. The words "a" and "one," as used in the claims and in the corresponding portions of the specification, are defined as including one or more of the referenced item unless specifically stated otherwise. This terminology includes the words above specifically mentioned, derivatives thereof, and words of similar import. The phrase "at least one" followed by a list of two or more items, such as "A, B, or C," means any individual one of A, B, or C as well as any combination thereof. The terminology includes the words specifically noted above, derivatives thereof and words of similar import.

The term "air gun" refers generally to any air gun with single or multiple stroke cocking means, and more particularly to break barrel type air rifles. The term "cocking mechanism" refers to those portions of the air gun associated with cocking or pressurization functions and include at least the air cylinder, pivot pins, cocking levers, and the piston; whether spring or gas actuated. The term "firing engine" includes the cocking mechanism as well as the trigger and valving for directing the pressurized air from the air cylinder to the breech end of the barrel to the back of the chamber in which the pellet or BB is located. The term "stock" refers to conventional gun stocks where the action is forward of the trigger assembly, and the butt of the stock (butt stock) is braced against the shoulder. Unless otherwise explained, any terms used herein have the same meaning as commonly understood by one of ordinary skill in the art to which this disclosure belongs. Although methods and materials similar or equivalent to those described herein can be used in the practice or testing of this disclosure, suitable methods and materials are described below.

Figure 2:
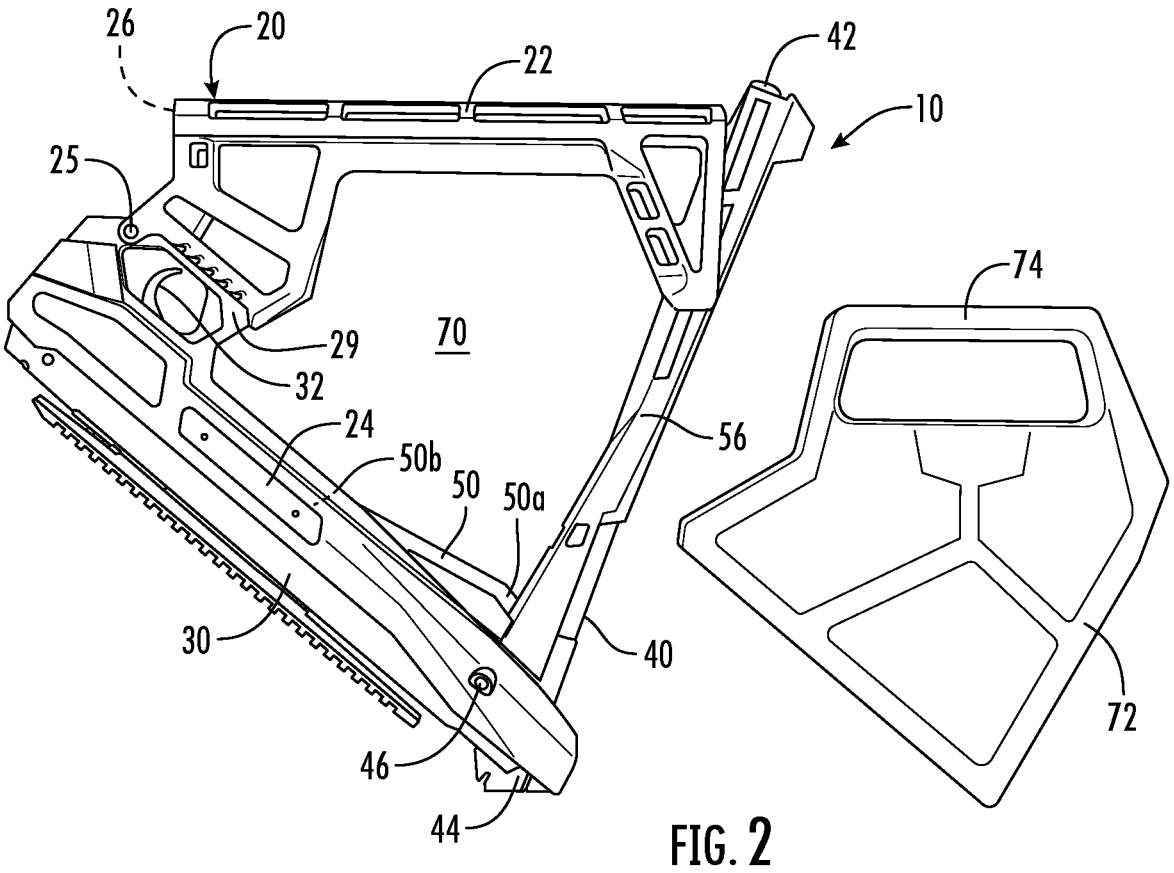
FIG. 2 is a view similar to FIG. 1 of the foldable break barrel air gun shown with the container separate from the foldable break barrel air gun which is shown in the stowed configuration.
Figure 5:
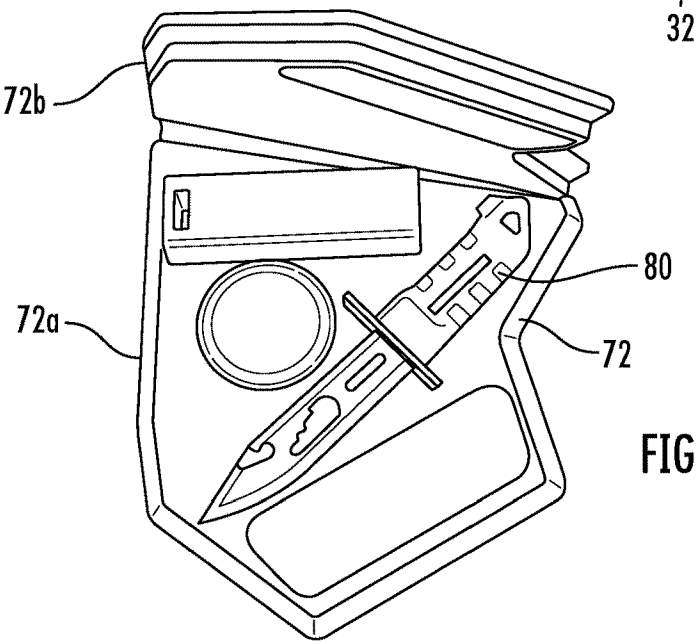
FIG. 5 is a view of the container shown with miscellaneous articles stored therein.
Figure 6:
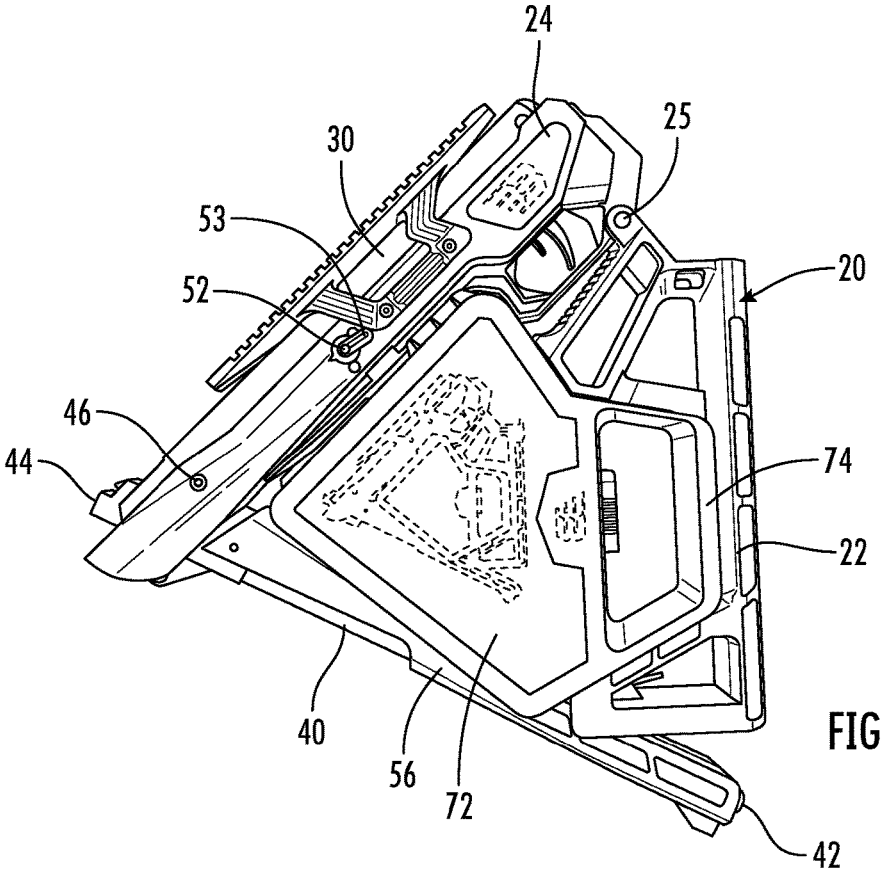
FIG. 6 is a view similar to FIG. 1 showing the foldable break barrel air gun in the stowed configuration with the container located in the stowage area.
Figure 7:
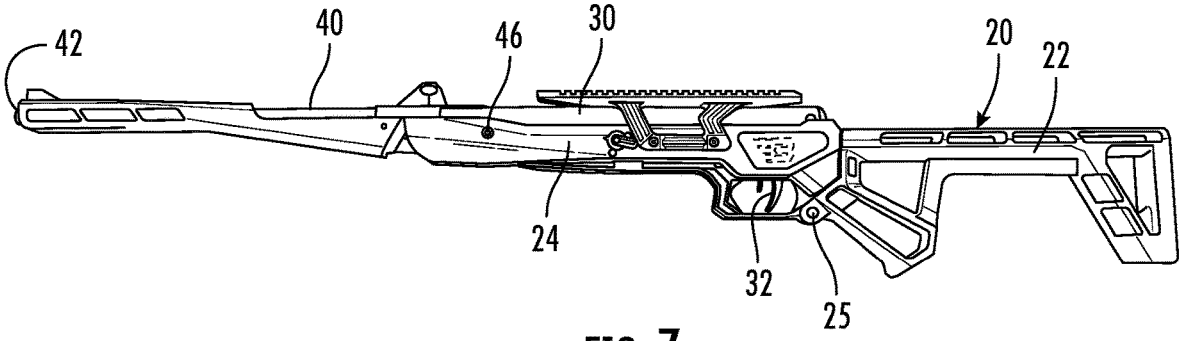
FIG. 7 is a view similar to FIG. 4 of a side view of the foldable break barrel air gun in the use configuration.
Figure 8:
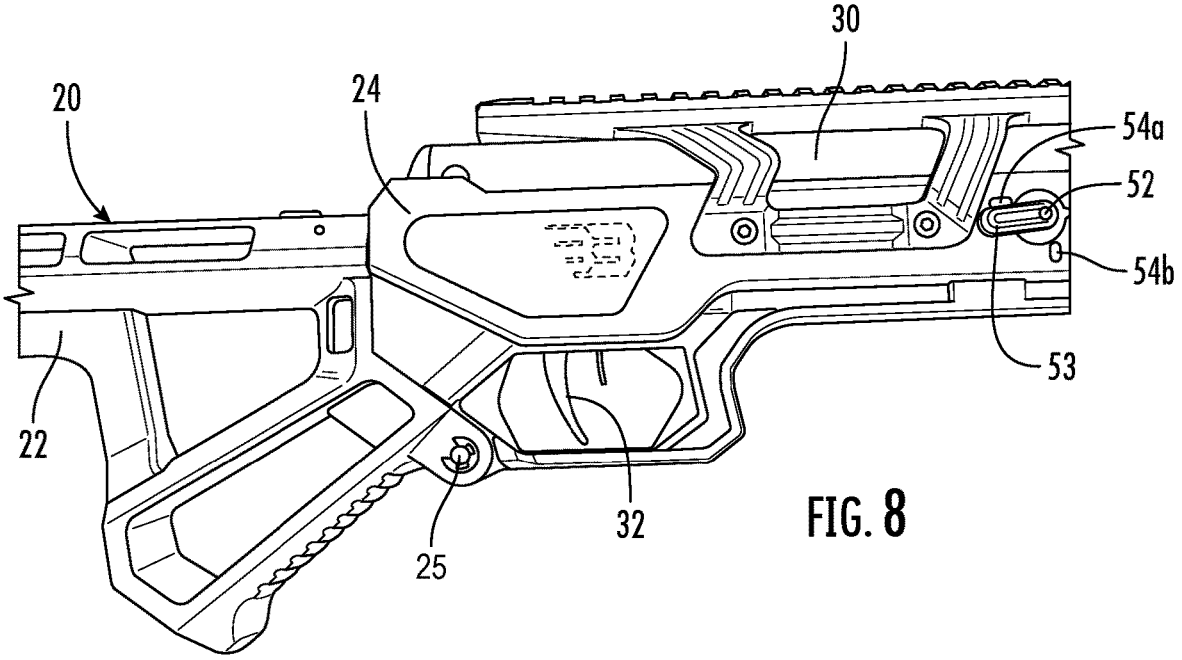
FIG. 8 is an enlarged detail view showing the pivotal connection between the butt stock and the forestock.
Figure 9:
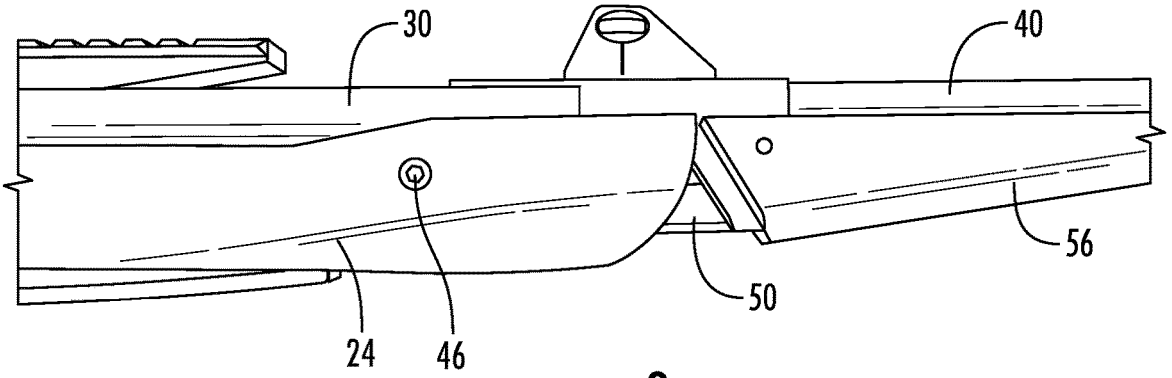
FIG. 9 is an enlarged detail view showing the pivotal connection between the barrel and the forestock.

Referring now to FIGS. 1-24, a foldable break barrel air gun 10 that is movable from a stowed configuration, shown for example in FIGS. 1, 2, and 6, to a use configuration, shown for example in FIGS. 4, 7-9, 14, and 19-23 is provided. The foldable break barrel air gun 10 includes a stock 20 comprising a butt stock 22 pivotally connected to a forestock 24 via a pivot connection 25. A firing engine 30 is located in or connected to the forestock 24. A releaseable stock latch 26, shown in detail in FIGS. 12 and 22 holds the butt stock 22 to the forestock, 24 in the use configuration. The releasable stock latch 26 is preferably biased via a spring 27 into a holding position where it engages over a catch 28. Here, the latch 26 is shown pivotally mounted in the butt stock 22 and the catch 28 is located at the back of the forestock 24. However, this configuration could be reversed. Additionally, other types of releaseable latches could be utilized.

In the preferred embodiment, the butt stock 22 is a molded plastic or composite part. The forestock 24 is preferably also a molded plastic or composite part. These provide light weight, moisture stable components that are more durable and less subject to damage than other materials. However, it is also possible to provide the butt stock 22 and/or the forestock 24 formed of other materials, such as wood or light-weight metal.

Figure 18:
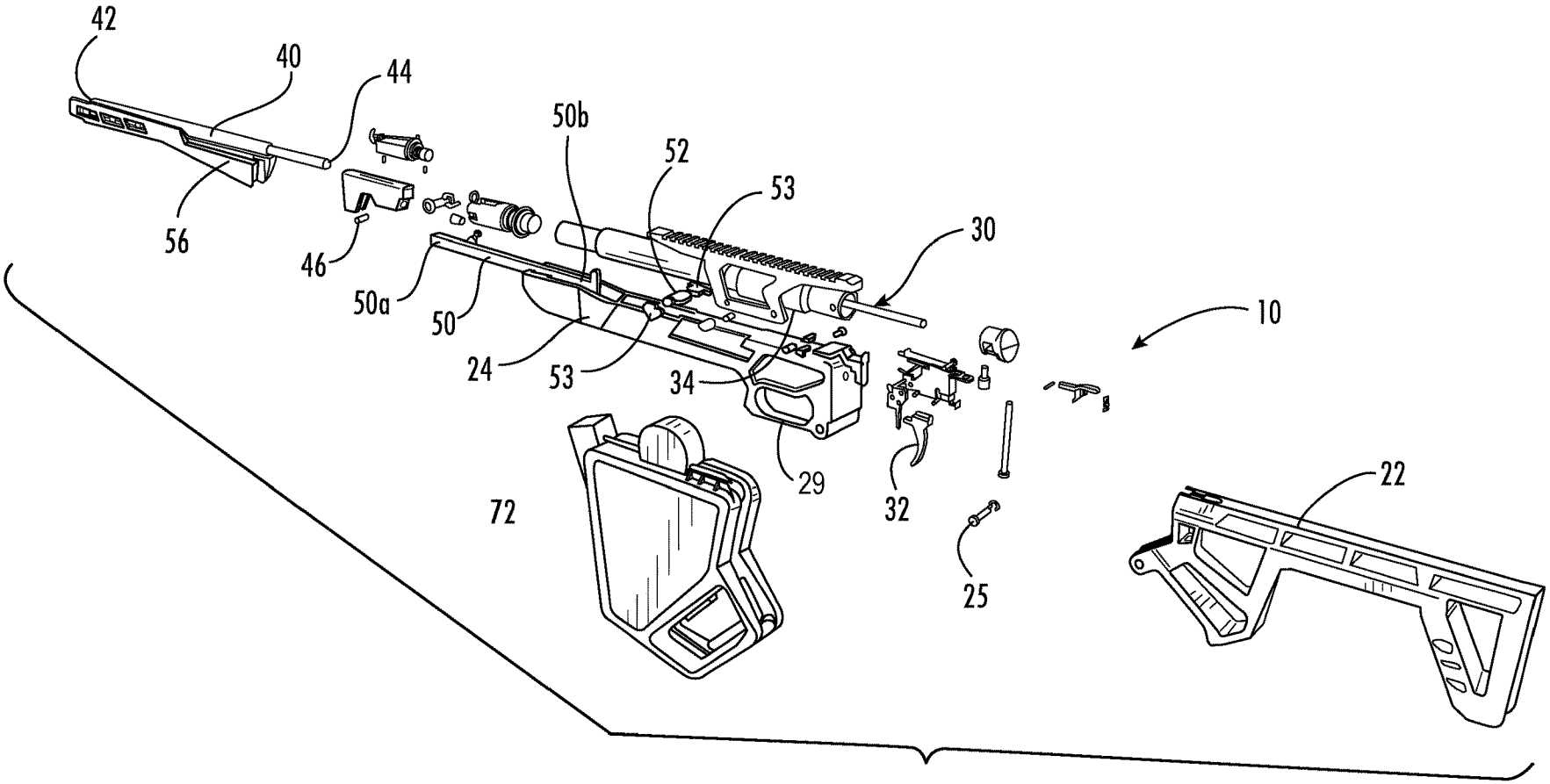
FIG. 18 is an exploded view showing components of the foldable break barrel air gun.
Figure 19:
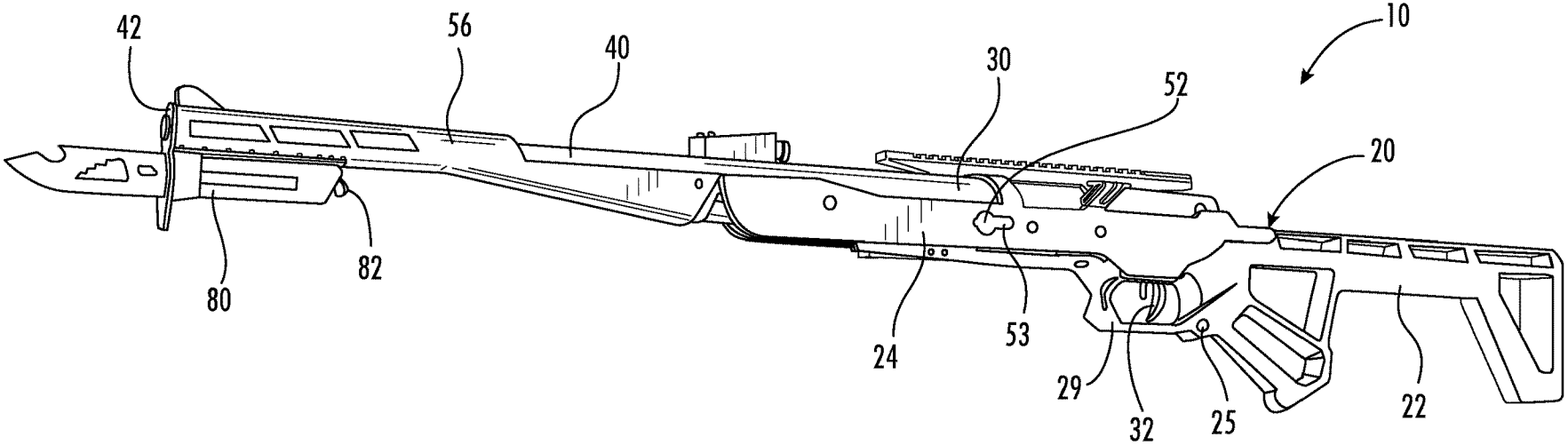
FIG. 19 is a partial perspective side view showing the foldable break barrel air gun in the use configuration with an auxiliary knife connected to the muzzle end of the barrel.

The firing engine 30, seen most clearly in FIGS. 18 and 20, may include a gas-spring or a spring-piston arrangement 34 that is activated via a cocking linkage 50 using the break barrel action, described in further detail below. As shown in FIGS. 18 and 19, the firing engine 30 has or is connected to a trigger 32 in order to fire the break barrel air gun 10 when it is in the use configuration.

As shown throughout the figures, the foldable break barrel air gun 10 also includes a barrel 40 having a muzzle end 42 and a breech end 44. The barrel 40 is pivotally connected to the forestock 24 proximate to the breech end 44. This connection is preferably via a pivot pin 46 that engages in an opening 48.

Figure 14:
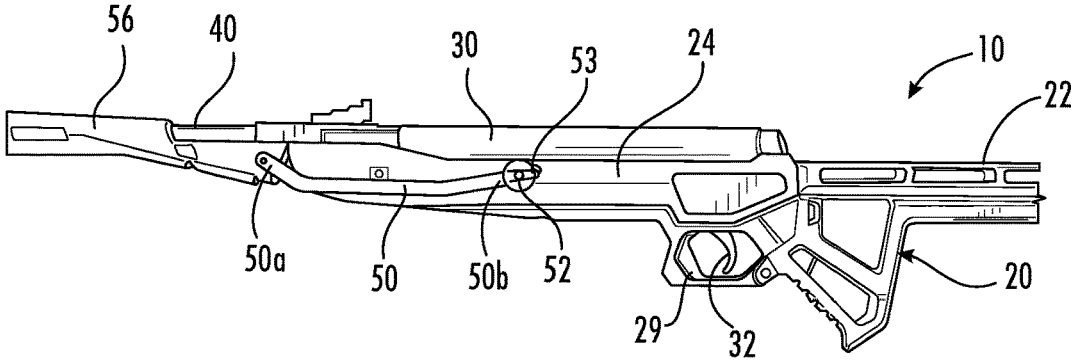
FIGS. 14-17 are a series of partial side views showing the disconnection and release of the cocking linkage from the firing engine required for folding the barrel relative to the forestock.
Figure 15:
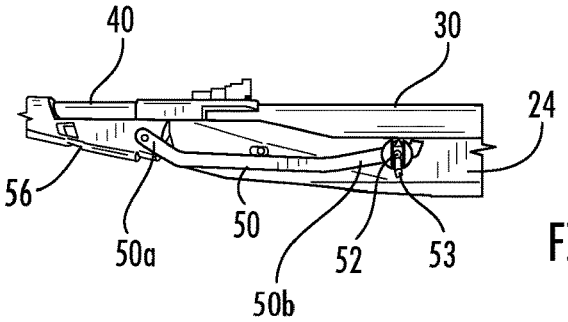
Figure 16:
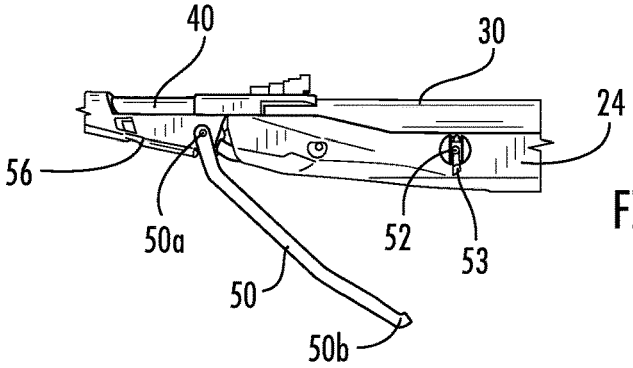
Figure 20:
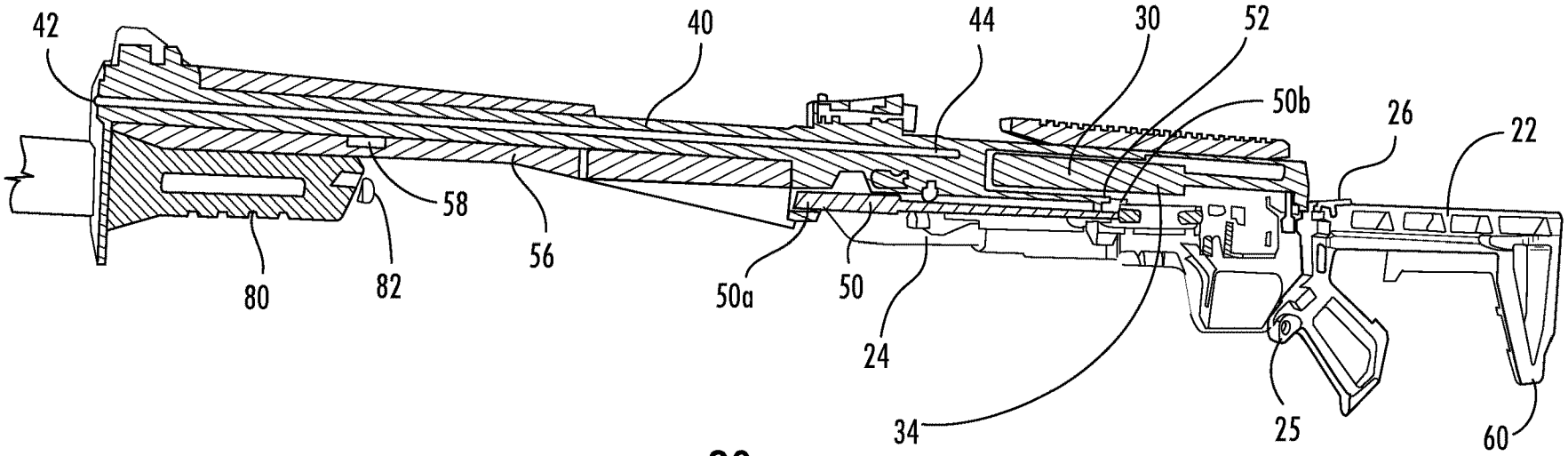
FIG. 20 is a cross-sectional view through the break barrel air gun shown in FIG. 19.
Figure 21:
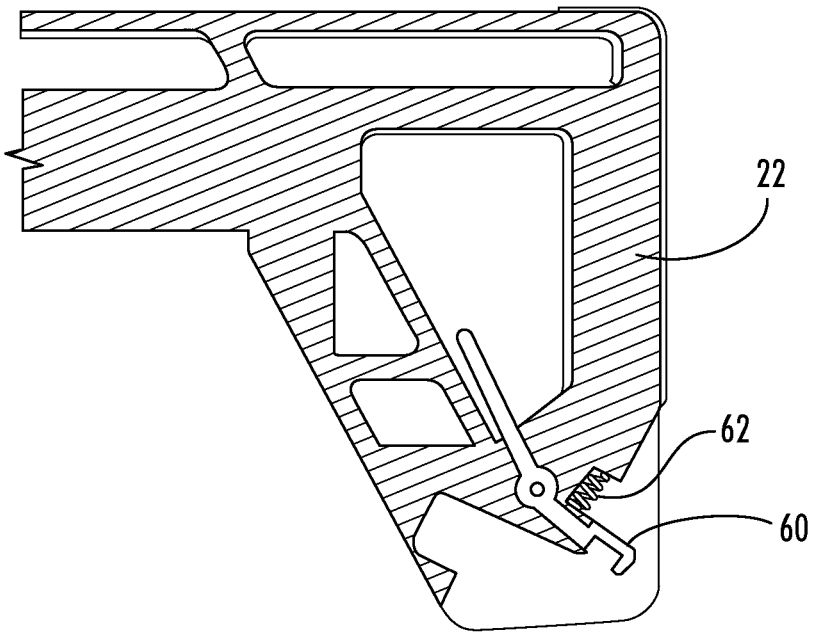
FIG. 21 is an enlarged cross-section view through the butt stock showing the barrel connecting latch that is used to connect the butt stock to the forestock proximate to the muzzle end of the barrel in the stowed configuration.
Figure 22:
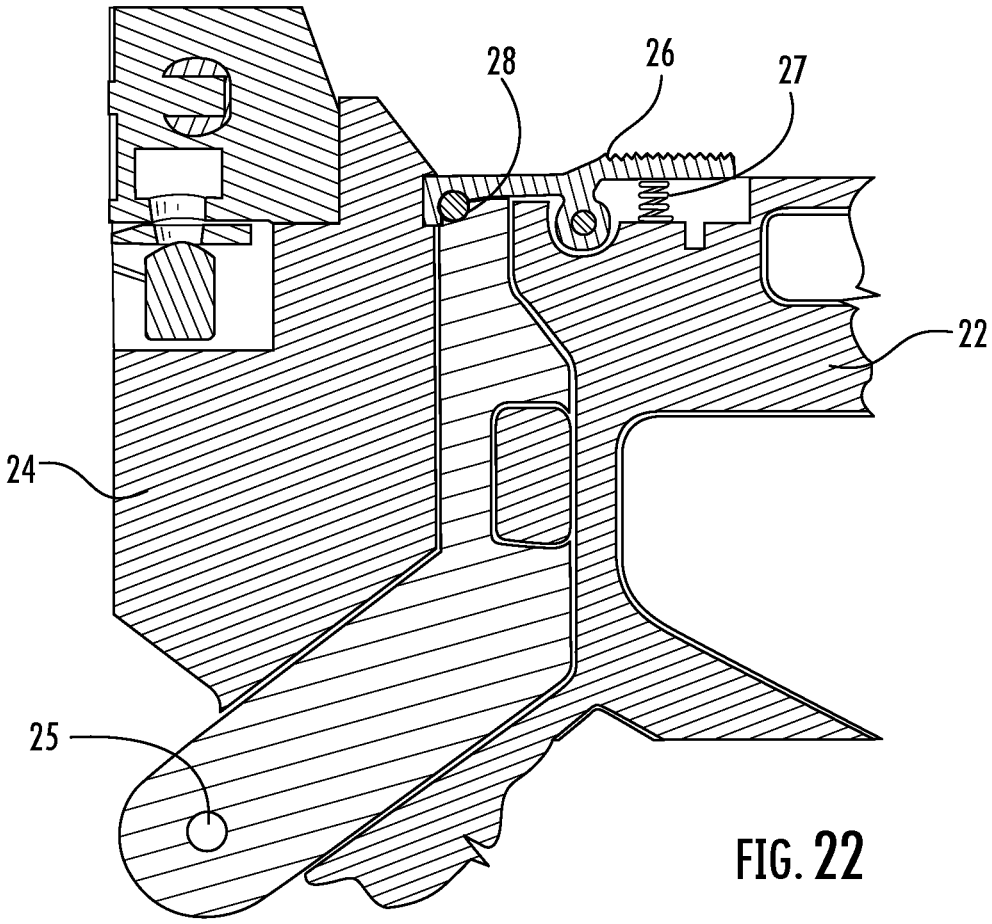
FIG. 22 is an enlarged cross-sectional view showing the releaseable stock latch that holds the butt stock to the forestock in the use configuration.
Figure 23:
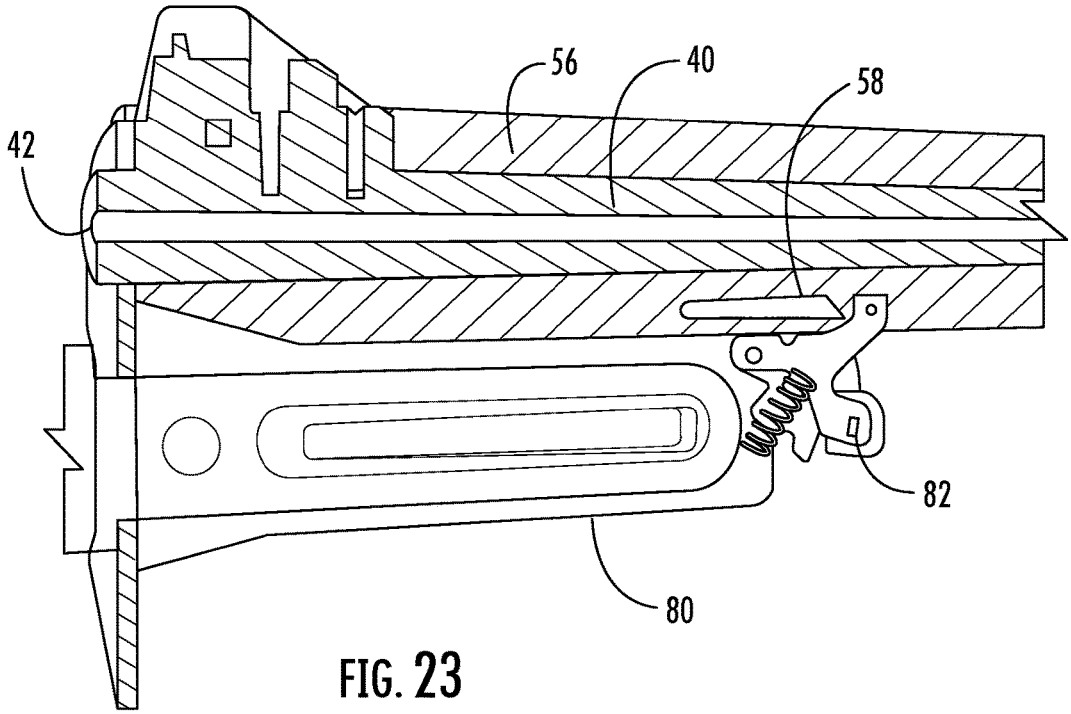
FIG. 23 is an enlarged cross-sectional view showing the muzzle end of the barrel with a fore end stock that is connected to the barrel showing the connection catch in the fore end stock as well as the pivotable latch connected to the auxiliary knife that is attachable to the muzzle end of the foldable break barrel air gun, with the catch in the fore end stock also being engageable by the barrel connecting latch in the stowed configuration.
Figure 24:
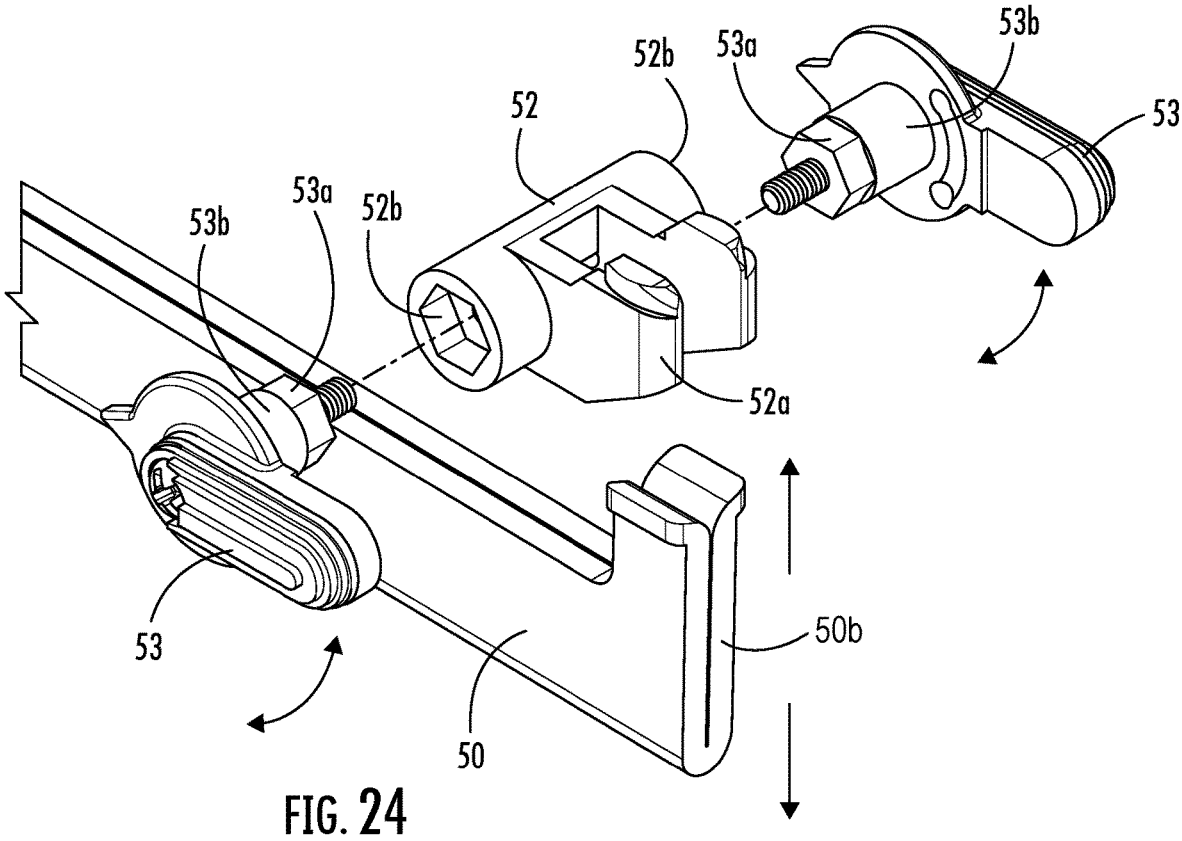
FIG. 24 is an exploded view of the releasable linkage connection components for releasably connecting a second portion or end of the cocking linkage to the firing engine.

As shown in detail in FIGS. 14 and 18 as well as in cross-section in FIG. 20, the cocking linkage 50 is pivotally connected at a first portion 50*a*, preferably at the first end, to the barrel 40, and is held in at least one of connected or engaged position at a second portion 50*b*, preferably the second end, to the firing engine 30 by a releasable linkage connection 52. In a preferred embodiment, the linkage connection 52 is formed as a rotatable clevis 52*a* that can be rotated via lever(s) 53 located on an outer surface of the forestock 24 from the position shown in detail in FIG. 8 where the lever part is parallel to the stock 20 and against a first stop 54*a*, to the position shown in FIG. 10, where the lever part is generally normal to the longitudinal direction of the stock 20 and barrel 40, and rests against a second stop 54*b*, in order to release the second portion or end 50*b* of the cocking linkage 50 (shown in FIG. 24 with an enlarged end portion 50*b* that is held in position engaged with the cocking mechanism by the clevis 52*a*) so that second portion or end 50*b* can be dropped down and out of its engaged position with the gas-spring or a spring-piston arrangement 34 of the firing engine 30. In FIG. 24, the levers 53 are shown having ends 53*a* that engage with a form fit into the recesses 52*b* in the sides of the releasable linkage connection 52. The levers 53 also include rotatable support surfaces 53*b* that provide rotatable support for the releasable linkage connection in the forestock 24.

Figure 3:
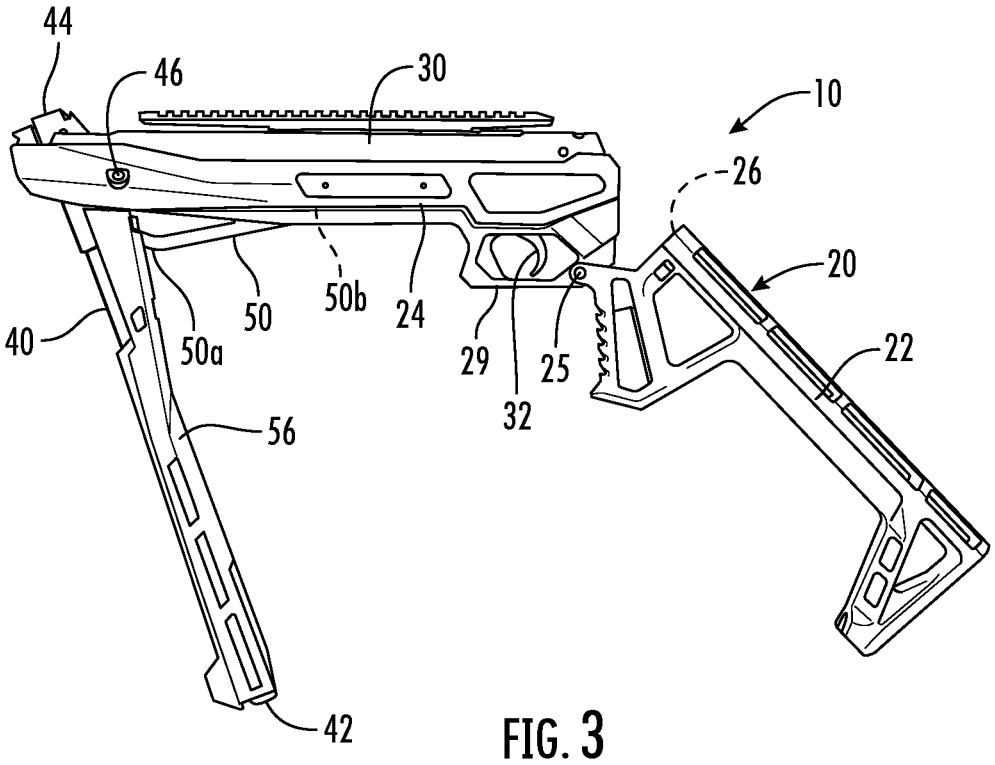
FIG. 3 is a side view showing the foldable break barrel air gun in a partially folded-open position from the stowed configuration.
Figure 4:
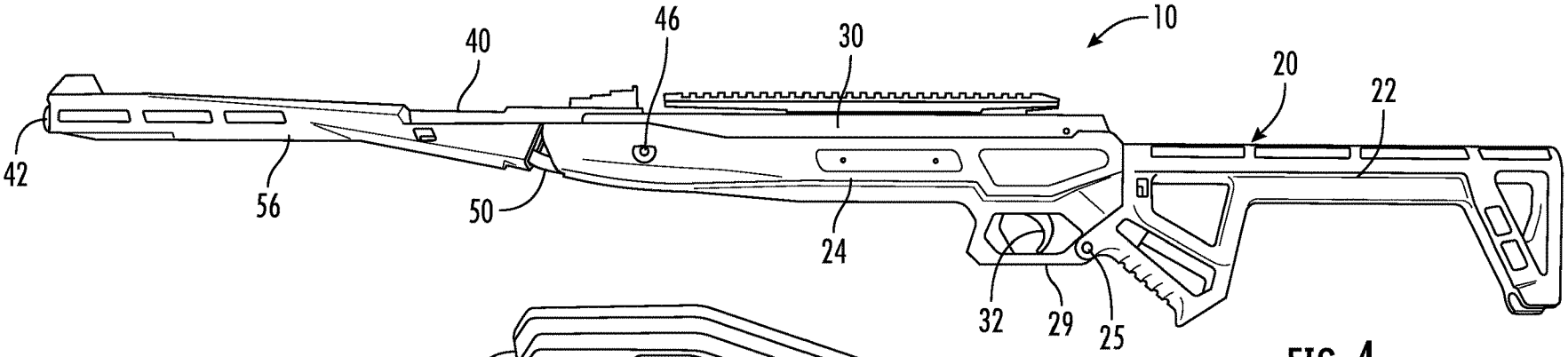
FIG. 4 is a side view of the foldable break barrel air gun of FIG. 3 shown fully un-folded in the use configuration.
Figure 10:
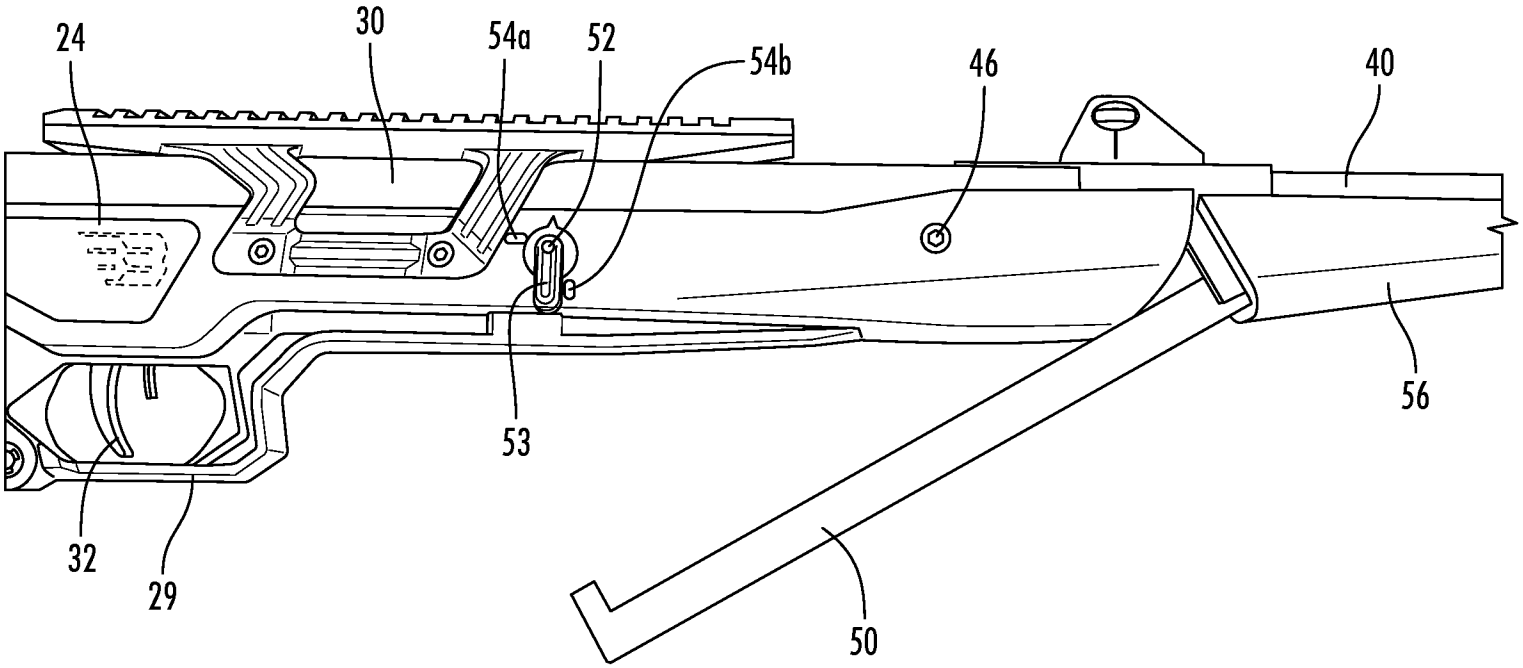
FIG. 10 is an enlarged view similar to FIG. 9 showing the cocking linkage in a released position from the firing engine.
Figure 11:
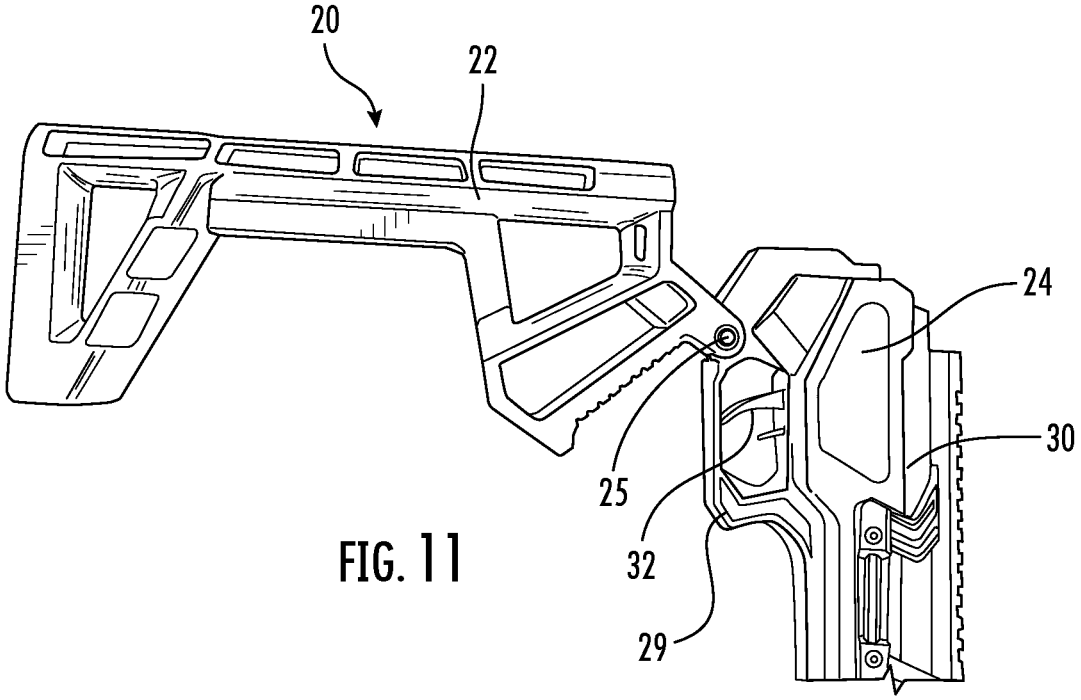
FIG. 11 is a detailed view showing the butt stock and the forestock partially pivoted relative to one another.
Figure 12:
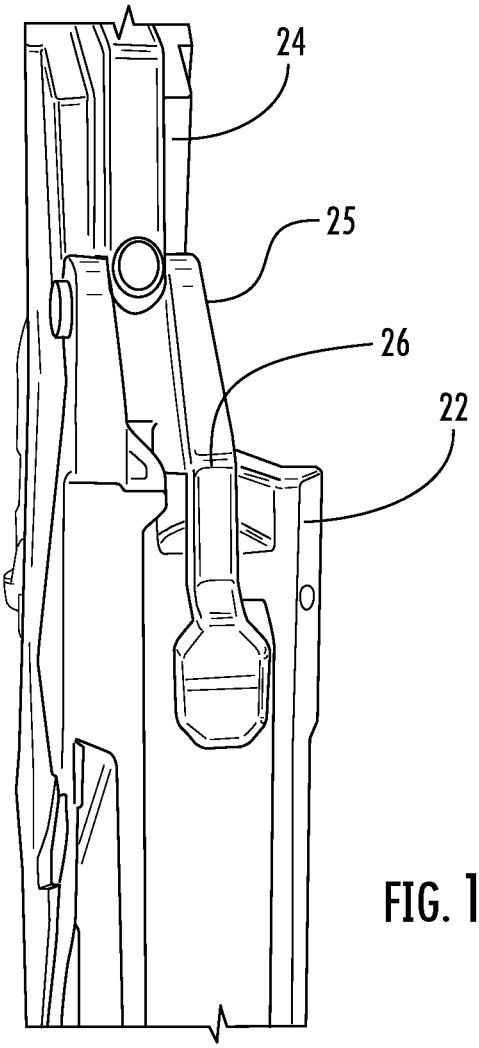
FIG. 12 is a detailed view showing a latch used to engage the butt stock to the forestock in the use configuration.
Figure 13:
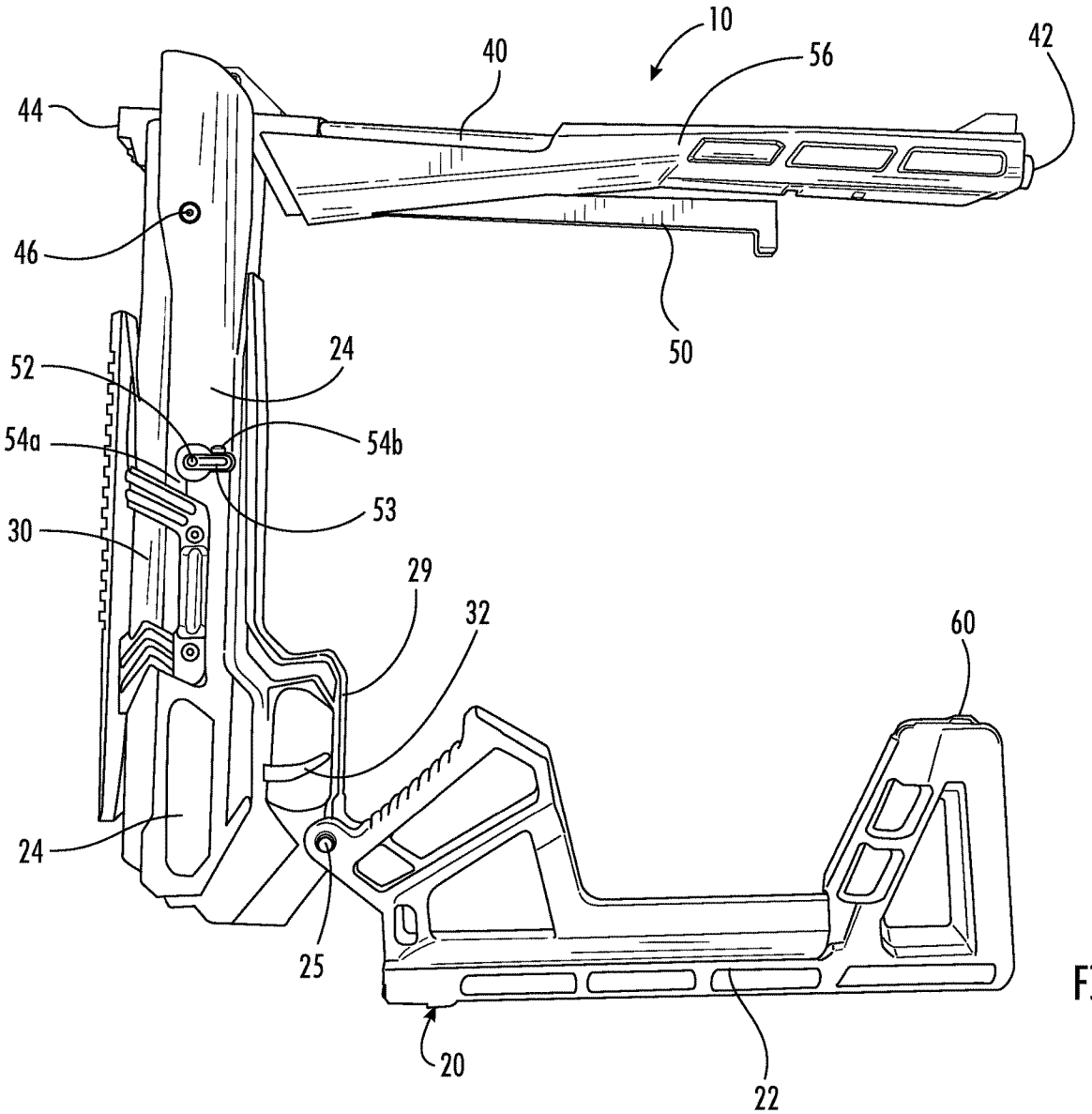
FIG. 13 is a detailed view showing the foldable break barrel air gun in a partially folded configuration with the cocking linkage having been released from the firing engine and folded into a position adjacent to the barrel.
Figure 17:
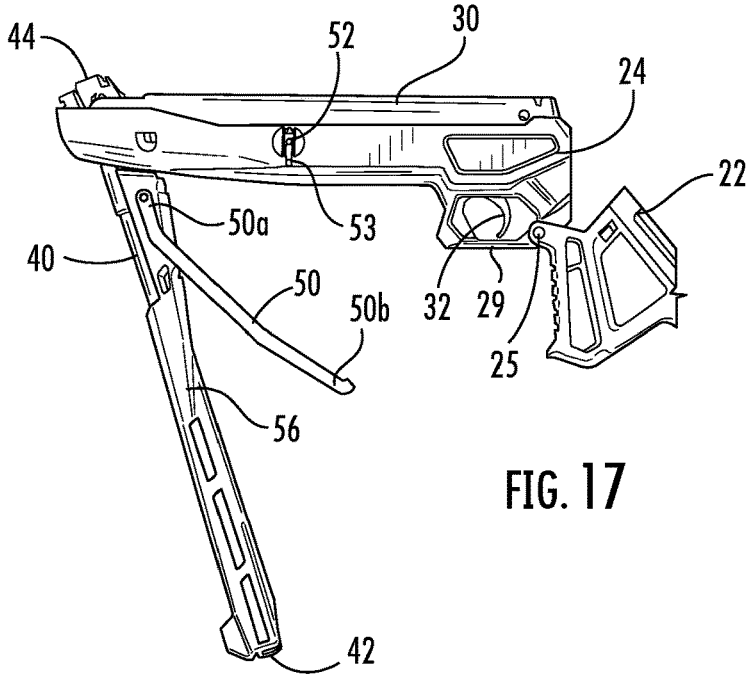

In the released position of the cocking linkage 50, shown in FIG. 10 and represented by the position of the cocking linkage in the exploded view in FIG. 24 (although in FIG. 24 the levers 53 are represented in the engaged position), the barrel 40 is foldable relative to the forestock 24 (without activating the cocking mechanism), such as shown in FIGS. 3, 13, and 17 such that when the butt stock 22 is folded relative to the forestock 24, for example as shown at FIGS. 11, 13, and 17, the butt stock 22 is attachable to the barrel 40 proximate to the muzzle end 42 in the stowed configuration, shown for example in FIGS. 1, 2, and 6. In the stowed configuration, a portion of the butt stock 22 in proximity to the pivotal connection 25 to the forestock 24 can be configured to contact a trigger guard 29 in the stowed configuration to limit a pivoting movement of the butt stock 22 relative to the forestock 24 in order to form a stable stowed configuration.

In the preferred embodiment, a fore end stock 56 is connected to the barrel 40, and the butt stock 22 is attachable to the fore end stock 56 proximate to the muzzle end 42 of the barrel 40 in the stowed configuration to provide the connection to the barrel 40. Preferably a catch 58 is located in the fore end stock which can be engaged by a releasable butt stock to barrel connecting latch 60 that releasably connects the butt stock 22 to the fore end stock 56 proximate to the muzzle end 42 of the barrel 40 in the stowed configuration. This connection latch 60 is shown in detail in FIG. 21 and is engageable with the catch 58 formed in the fore end stock 56. Preferably, the connecting latch 60 is biased to a closed position via a spring 62.

As shown in detail in FIGS. 13 and 15-17, preferably the cocking linkage 50 is foldable to a position adjacent to the barrel 40 in the stowed configuration after the releaseable linkage connection 52 is moved via the levers 53 to the release position. This allows the foldable break barrel air gun 10 to be folded to the stowage configuration.

As is known to those of ordinary skill in this field, the foldable break barrel air gun 10 is cocked when it is in the use position by a user grasping the barrel 40 and folding it downwardly relative to the butt stock 22 and forestock 24 such that the cocking linkage 50, which is held with the second end 50*b* in the engaged position with the firing engine 30 by releasable linkage connection 52, compresses the gas-spring or spring-piston 34 in order to store energy which can be released once the trigger 32 is pulled in order to provide compressed air to "fire" the pellet or BB.

As shown in FIGS. 1 and 2, the foldable break barrel air gun 10 includes a stowage area 70 formed between the butt stock 22, the forestock 24, and the barrel 40, or the fore end stock 56 connected to the barrel 40, in the stowed configuration. A container 72 is provided and is locatable in the stowage area 70 and is configured to engage at least one of the butt stock 22, the forestock 24, or the barrel 40 (or the fore end stock 56 connected to the barrel 40), preferably via the container having a form-fit with part of the air gun 10 that surrounds the stowage area 70. As shown in FIGS. 2 and 5, the container 72 includes a handle portion 74 and the butt stock 22 includes a recess 23 in which the handle portion 74 is received in the stowed configuration.

The container 72 is preferably formed of a molded plastic or composite material. Preferably, the container 72 includes a base part 72*a* and a hinged cover 72*b* that is connected to the base part 72*a*. Various accessories to the foldable break barrel air gun 10 can be provided, for example a survival knife 80 as shown in FIG. 5 that can be connected to the muzzle end 42 of the barrel 40, as shown in FIG. 19 and engaged via a releasable catch 82, shown in FIG. 23, to the fore end stock 56 when the break barrel air gun 10 is in the use configuration. This can engage the same catch 58 as the connecting latch 60.

By providing the foldable break barrel air gun 10 that can be moved between the stowed configuration and the use configuration, the overall break barrel air gun 10 is more compact for storage as well as carrying, making it more convenient for users.

Having thus described the present disclosure in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the embodiments being indicated by the appended claims rather than by the foregoing description, and all alternate embodiments and changes to this embodiment which come within the meaning and range of equivalency of said claims are therefore to be embraced therein.

What is claimed is:

1. A foldable break barrel air gun that is movable from a stowed configuration to a use configuration, the foldable break barrel air gun comprising:

a stock including a butt stock pivotally connected to a forestock in which a firing engine is located;

a barrel having a muzzle end and a breech end, the barrel being pivotally connected to the forestock proximate the breech end;

a cocking linkage having a first portion that is pivotally connected to the barrel and a second portion that is held in at least one of connected or engaged position with the firing engine by a releasable linkage connection;

wherein, with the releasable linkage connection in a released position and the second portion of the cocking linkage is disengaged from the firing engine, the butt stock is foldable relative to the forestock, and the barrel is foldable relative to the forestock such that the butt stock is attachable to the barrel proximate to the muzzle end in the stowed configuration.

2. The air gun of claim 1, further comprising a releasable stock latch that holds the butt stock to the forestock in the use configuration.

3. The air gun of claim 1, further comprising a fore end stock connected to the barrel, and the butt stock is attachable to the fore end stock proximate to the muzzle end of the barrel in the stowed configuration.

4. The air gun of claim 3, further comprising a releasable butt stock to barrel latch that releasably connects the butt stock to the fore end stock proximate to the muzzle end of the barrel in the stowed configuration.

5. The air gun of claim 1, wherein the cocking linkage is foldable to a position adjacent to the barrel in the stowed configuration.

6. The air gun of claim 1, wherein the butt stock is a molded plastic or composite part.

7. The air gun of claim 1, wherein the forestock is a molded plastic or composite part.

8. The air gun of claim 1, wherein the releasable linkage connection includes a lever that is located on an outer surface of the forestock.

9. The air gun of claim 1, wherein a portion of the butt stock in proximity to the pivotal connection to the forestock is configured to contact a trigger guard in the stowed configuration to limit a pivoting movement of the butt stock relative to the forestock.

10. The air gun of claim 1, further comprising a stowage area formed between the butt stock, the forestock, and the barrel in the stowed configuration, and a container located in the stowage area that is configured to engage at least one of the butt stock, the forestock, and the barrel.

11. The air gun of claim 10, wherein the container includes a handle portion, and the butt stock includes a recess in which the handle portion is received in the stowed configuration.

12. The air gun of claim 10, wherein the container is formed of a molded plastic or composite material.

13. The air gun of claim 10, wherein the container includes a base part and a hinged cover connected to the base part.

14. The air gun of claim 1, further comprising a trigger for activating the firing engine.

15. The air gun of claim 1, wherein the firing engine includes a gas-spring.

16. The air gun of claim 1, wherein the firing engine includes a spring-piston.

* * * * *